United States Patent [19]

Matsuda

[11] Patent Number: 4,781,132

[45] Date of Patent: Nov. 1, 1988

[54] FULL ROTARY LOOP TAKER ASSEMBLY FOR SEWING MACHINES

[75] Inventor: Kimikazu Matsuda, Kyoto, Japan

[73] Assignee: Maruzen Sewing Machine Co., Ltd., Osaka, Japan

[21] Appl. No.: 115,603

[22] Filed: Oct. 29, 1987

[51] Int. Cl.[4] ..... D05B 57/14

[52] U.S. Cl. ..... 112/228

[58] Field of Search ..... 112/228, 229, 231, 189, 112/190, 181, 182

[56] References Cited

U.S. PATENT DOCUMENTS 1,343,823 6/1920 Hohmann ..... 112/228 X
2,148,385 2/1939 Waterman ..... 112/228 X
2,219,470 10/1940 Carlson .

FOREIGN PATENT DOCUMENTS 61-80382 5/1986 Japan .
62-1794 1/1987 Japan .

*Primary Examiner*—H. Hampton Hunter

*Attorney, Agent, or Firm*—Lowe, Price, Leblanc, Becker & Shur

[57] ABSTRACT

A full rotary loop taker assembly comprising a loop taker (11) rotatably held in a loop taker support (1), and a driver (3) for rotatively driving the loop taker as it is rotated around a rotative axis (4) intersecting the rotative axis (12) of the loop taker. The loop taker is formed on its bottom surface wall (16) with at least three angularly spaced engaging holes (17*a*, 17*b*, 17*c*). The driver is formed with at least three angularly spaced projections (10*a*, 10*b*, 10*c*) adapted to be received in the engaging holes. During the rotation of the driver, the projections are successively received in the corresponding engaging holes in such a manner as to ensure that there is always at least one projection which has been received in the corresponding engaging hole. Further, to allow passage of an upper thread loop (23), in a predetermined angular range in the rotation of the driver the respective projections are ready to escape from the corresponding holes.

5 Claims, 4 Drawing Sheets

FULL ROTARY LOOP TAKER ASSEMBLY FOR SEWING MACHINES

BACKGROUND OF THE INVENTION

1. Field of the Invention

This invention relates to a full rotary loop taker assembly for sewing machines, and more particularly to a full rotary loop taker assembly of the type in which the rotatable loop taker is rotated as it receives rotation from a driver driven for rotation around an axis which intersects the rotative axis of said loop taker.

2. Description of the Prior Art

A prior art which is of interest to this invention is disclosed in U.S. Pat. No. 2,219,470, entitled "Shuttle Mechanism," published Oct. 29, 1940 and granted to Carlson. In this prior art, the loop taker or shuttle is supported for rotation around a first rotative axis by a shuttle support. On the other hand, a driver for imparting rotation to the shuttle is driven for rotation around a second rotative axis which intersects the first rotative axis. The driver is provided with two diametrically opposed projections, while the shuttle is provided with two diametrically opposed engaging holes or slots, said slots being adapted to respectively receive the projections on the driver.

In such arrangement, when the driver is rotated, two projections are alternately received in the corresponding engaging holes, whereby the shuttle is rotated. That is, immediately before one projection escapes from the corresponding engaging hole, the other projection enters the corresponding engaging hole, so that the shuttle is continuously rotated at a uniform speed. In addition, such rotation of the shuttle is effected in synchronism with the reciprocating motion of the sewing needle.

Thus, the shuttle mechanism disclosed in U.S. Pat. No. 2,219,470 is arranged so that the two projections alternately enter the respective corresponding holes to drive the shaft for rotation; but it has the following problem. This problem stems from the fact that immediately before one projection escapes from the corresponding engaging hole, the other projection enters the corresponding engaging hole but that the degree of this entry is very low. When the shuttle arresting the upper thread loop draws said upper thread loop, it is subjected to a resistance, from this upper thread, opposite to the direction of rotation. Therefore, the rotation of the shuttle sometimes fails to proceed as desired, and the projection, which should ordinarily enter the corresponding engaging hole, tends to go under the bottom surface of the shuttle. Nevertheless, the driver is rotatively driven, with the result that the projection applies an upward force to the shuttle. As this time, since the shuttle is held down by a cover which closes the shuttle support, a strong frictional force is produced between the shuttle and the cover, making it impossible for the shuttle to rotate smoothly.

SUMMARY OF THE INVENTION

Accordingly, an object of the invention is to provide a full rotary loop taker assembly for sewing machines wherein the transmission of rotation from the driver to the shuttle or loop taker can be effected more reliably.

A loop taker assembly according to the invention comprises a loop taker supported for rotation around a first rotative axis and having a bottom surface wall defining a bottom surface which forms a surface of rotation around the first rotative axis, a loop taker support means which supports said loop taker for rotation around said first rotative axis, and driver means driven for rotation around a second rotative axis which intersects said first rotative axis at a predetermined intersecting point. The driver means has at least three projections, said projections being disposed in a surface perpendicular to the second rotative axis and being angularly spaced with an angular distance of less than 180 degrees at positions equidistant from said second rotative axis. On the other hand, the loop taker has at least three engaging holes in its bottom surface wall for receiving said respective projections. These engaging holes are angularly spaced around the first rotative axis. The first and second rotative axes are in positional relationship such that in a predetermined angular range in the rotation of the driver means, the respective projections are ready to escape from the corresponding engaging holes and during the rotation of the driver means the projections are successively received in the corresponding engaging holes in such a manner as to ensure that there is always at least one projection which has been received in the corresponding engaging hole.

According to this invention, since at least three projections are angularly spaced with an angular distance of less than 180 degrees, it is possible to ensure that there is always at least one projection which has fully entered the corresponding engaging hole. In other words, when a certain projection is about to escape from the corresponding engaging hole, another projection has already fully entered the corresponding engaging hole. Therefore, the transmission of rotation from the driver means to the loop taker can be continuously and stably effected, and hence the loop taker can be rotated more stably.

In a preferred embodiment of the invention, the number of projections is three, and these projections are angularly spaced with an equal angular distance, i.e., 120 degrees. This is significant in that the effect of the invention can be expected with the smallest number of projections and in that an advantage is attained that with a certain projection escaping from the corresponding engaging hole, it is possible to create a sufficient clearance to allow the upper thread to pass along the bottom surface of the loop taker.

Further, in a preferred embodiment of the invention, the intersection of the first and second rotative axes is positioned on or adjacent the bottom surface of the loop taker. Thereby, the entry of each projection into the corresponding engaging hole is made smooth.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
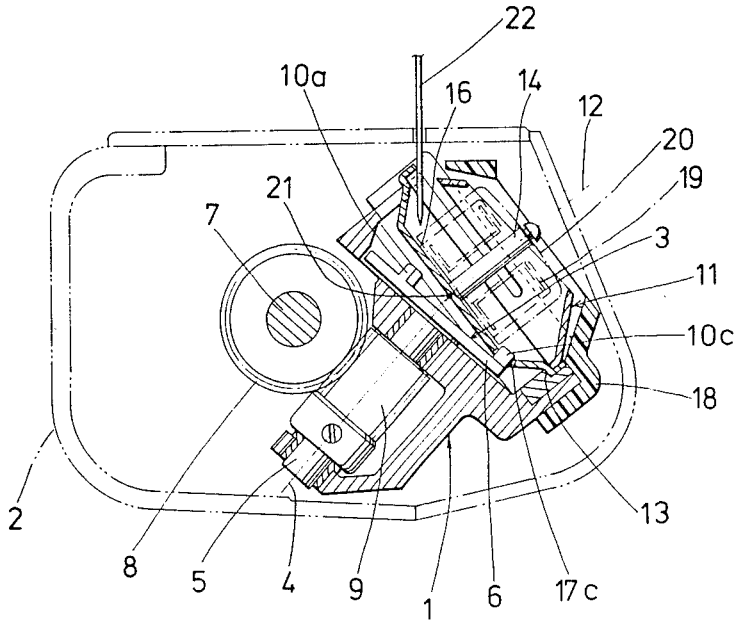
FIG. 1 is a sectional view showing a full rotary loop taker assembly according to an embodiment of the invention.
Figure 2:
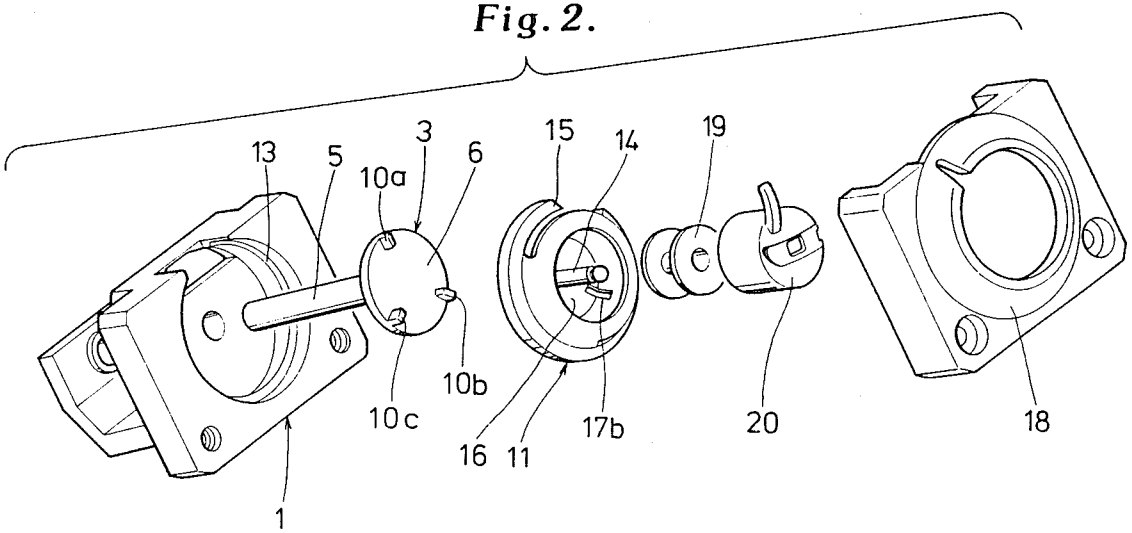
FIG. 2 is an exploded perspective view showing elements forming the loop taker assembly shown in FIG. 1.

Referring mainly to FIGS. 1 and 2, a loop taker support 1 is fixedly attached to the bed 2 of a sewing machine, shown in phantom lines in FIG. 1, as by screws, not shown. The support 1 supports a driver 3 for rotation around a rotative axis 4 shown in a dash-dot line in FIG. 1. The driver 3 is provided with a shaft portion 5 and a disk portion 6. Disposed in the bed 2 is a lower shaft 7 driven for rotation as by a motor, not shown. The driver 3 is rotated as it receives the rotation of the lower shaft through a suitable gear transmission mechansim. For example, in the illustrated embodiment, the gear transmission mechanism is constituted by a spiral gear 8 attached to the lower shaft 7 and a spiral gear 9 meshing therewith and attached to the shaft portion 5. The disk portion 6 of the driver 3 provides a surface perpendicular to the rotative axis 4. Disposed on this surface are three driving projections 10*a*, 10*b* and 10*c* which are angularly spaced with an angular distance of 120 degrees at positions equidistant from the rotative axis 4.

A loop taker 11 is held by the loop taker support 1 so that it is rotatable around a rotative axis 12 shown in a dash-dot line in FIG. 1. To hold the loop taker 11 in this manner, the support 1 is formed with a race 13. The loop taker 11 is provided with a spindle 14 for supporting a bobbin 19 and a bobbin case 20 shown in FIG. 2, and a hook 15 for arresting an upper thread loop. Further, the loop taker 11 has a bottom surface wall 16 which defines a bottom surface in the form of a rotary surface with the center at its rotative axis 12. The bottom surface wall 16 is formed with three engaging holes 17*a*, 17*b* and 17*c* for receiving the driving projections 10*a*, 10*b* and 10*c*, respectively. In addition, the relative positional relationship of these three engaging holes 17*a*, 17*b* and 17*c* is shown, for example, in FIG. 3A. As can be seen from this figure, and three engaging holes 17*a*, 17*b* and 17*c* are angularly spaced with an angular distance of 120 degrees around the central axis of the spindle 14 or the rotative axis 12.

The loop taker 11 rotatably supported by the support 1 is held down by a support cover 18 fixed to the support 1 as by screws and is thereby prevented from slipping off the support 1. Though not shown in FIG. 1, the bobbin 19, as received in the bobbin case 20, is mounted on the loop taker 11.

As shown in FIG. 1, the rotative axis 4 of the driver 3 intersects the rotative axis 12 of the loop taker 11 at an intersecting point 21. The positional relationship of these rotative axes 4 and 12 is such that in a predetermined angular range in the rotation of the driver 3, the respective projections 10*a*, 10*b* and 10*c* are ready to escape from the corresponding engaging holes 17*a*, 17*b* and 17*c* and during the rotation of the driver 3 the projections 10*a*, 10*b* and 10*c* are successively received in the corresponding engaging holes 17*a*, 17*b* and 17*c* in such a manner as to ensure that there is always at least one projection which has been received in the corresponding engaging hole 17*a*, 17*b* or 17*c*.

In this embodiments, as shown in FIG. 1, the point of intersection 21 between the rotative axes 4 and 12 is positioned on or adjacent the bottom surface defined by the bottom surface wall 16 of the loop taker 11. This arrangement makes more smooth the transmission of the rotation from the driver 3 to the loop taker 11 through the projections 10*a*, 10*b* and 10*c*.

The operation of the loop taker 11 rotatively driven by the driver 3 will now be described with references to FIGS. 3A through 3F and FIGS. 4A through 4F.

Figure 3A:
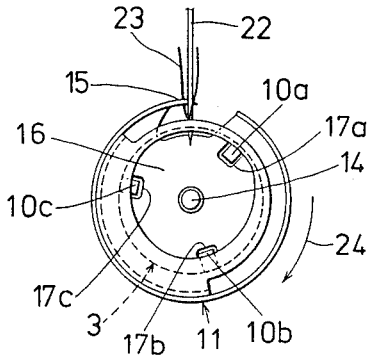
FIGS. 3A through 3F are top views of the loop taker for explaining the operation of the loop taker shown in FIG. 1.
Figure 4A:
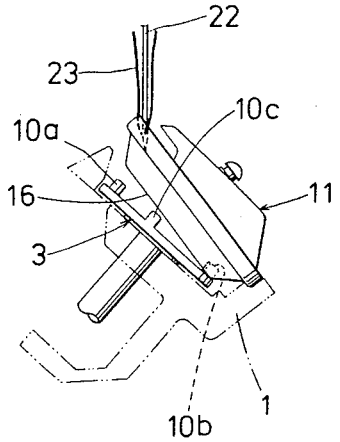
FIGS. 4A through 4F, which correspond to FIGS. 3A through 3F, respectively, are side views of the loop taker.

First, as shown in FIG. 3A, when the sewing needle 22 rises slightly above the lower dead point thereof, the loop taker 11 being rotatively driven in the direction of arrow 24 arrests the needle thread loop or upper thread loop 23 by its hook 15. At this time, as shown in FIG. 4A, the driving projection 10*b* is engaged with the corresponding engaging hole 17*b*, whereby the rotation of the driver 3 is transmitted to the loop taker 11. In addition, the projection 10*c*, as shown in FIG. 4A, has just escaped from the corresponding engaging hole 17*c*.

Figure 3B:
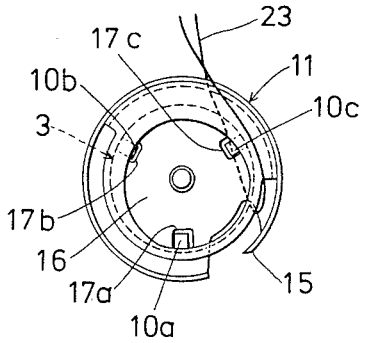
Figure 4B:
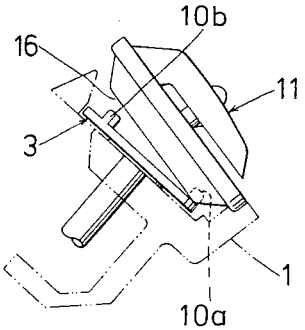

When the loop taker 11 is rotated through about 135 degrees from the above state, the projection 10*a* engages the corresponding engaging hole 17*a*, as shown in FIG. 4B, to rotatively drive the loop taker 11. At this time, though not shown, since the projection 10*c* still maintains its state of escaping from the corresponding engaging hole 17*c*, the portion of the upper thread loop 23 lying on the lower surface of the loop taker 11 tends to pass between the bottom surface wall 16 and the projection 10*c*, as shown in FIG. 3B.

Figure 3C:
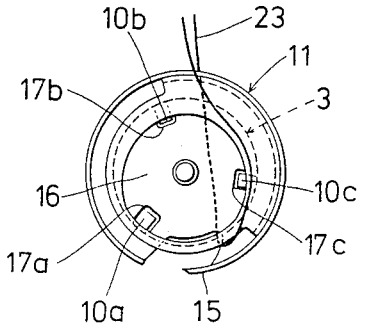
Figure 4C:
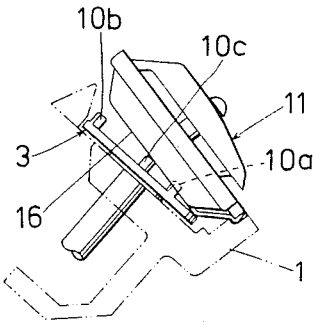

Subsequently, when the loop taker 11 further rotates through about 45 degrees, the projection 10*c*, as shown in FIG. 4C, begins to enter the corresponding engaging hole 17*c* to rotatively drive the loop taker 11. At this time, as shown in FIG. 3C, the portion of the upper thread loop 23 lying on the lower side of the loop taker 11 has already passed between the bottom surface wall 16 of the loop taker 11 and the projection 10*c*.

Figure 3D:
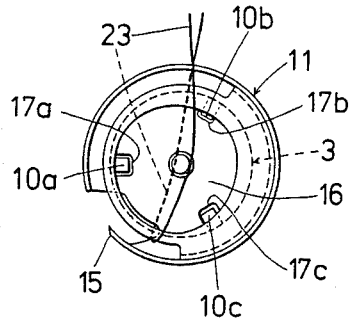
Figure 4D:
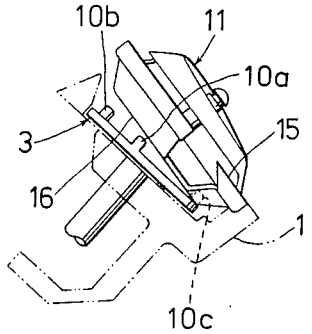

Subsequently, when the loop taker 11 further rotates through about 45 degrees, the portion of the upper thread loop 23 lying on the lower side of the loop taker 11, as shown in FIG. 3D, passes between the projection 10*b* and the bottom surface wall 16. At this time, as shown in FIG. 4D, the projection 10*c* engages the corresponding engaging hole 17*c* to rotatively drive the loop taker 11, while the projection 10*a* has just escaped from the corresponding engaging hole 17*a*.

Figure 3E:
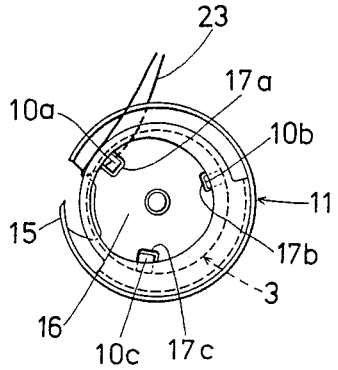
Figure 4E:
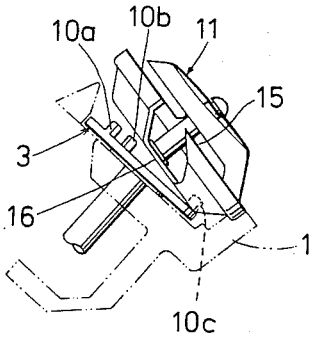

When the loop taker 1 further rotates through about 45 degrees, the projection 10*c*, as shown in FIG. 4E, engages the corresponding engaging hole 17*c* whereby the loop taker 11 continues to be rotatively driven, but the projection 10*a* has already escaped from the corresponding engaging hole 17*a*, so that the portion of the upper thread loop 23 lying on the lower side of the loop taker 11 passes between the projection 10*a* and the bottom surface wall 16, as shown in FIG. 3E.

Figure 3F:
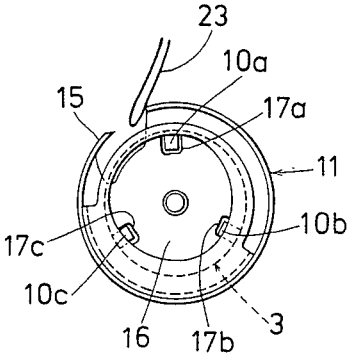
Figure 4F:
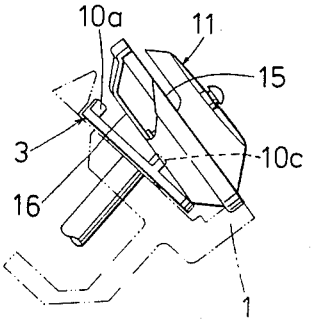

The state of the loop taker 11 having further rotated through about 45 degrees is shown in FIGS. 3F and 4F. In this state, the projection 10*b* begins to engage the corresponding engaging hole 17*b* and cooperates with the projection 10*c*, which has already engaged the engaging hole 17*c*, to rotatively drive the loop taker 11.

While the invention has been described with reference to the illustrated embodiment, modifications are possible within the scope of the invention.

For example, while three projections 10*a*, 10*b* and 10*c* have been provided, four or more projections may be provided. In the case where four or more projections are provided, the number of engaging holes should be correspondingly increased. However, it is not always necessary that the number of projections be equal to the number of engaging holes. For example, a greater number of engaging holes than that of projections may be provided, some of the engaging holes being unused.

While the projections 10*a*, 10*b* and 10*c* are angularly spaced preferably with an equal angular distance, it should be pointed out that spacing them with unequal angular distances also falls under the scope of the invention.

Although the present invention has been described and illustrated in detail, it is clearly understood that the same is by way of illustration and example only and is not to be taken by way of limitation, the scope of the present invention being limited only by the terms of the appended claims.

What is claimed is:

1. A full rotary loop taker assembly for sewing machines, comprising:

a loop taker (11) supported for rotation around a first rotative axis (12) and having a bottom surface wall (16) defining a bottom surface which forms a surface of rotation around the first rotative axis;

a loop taker support means (1) which supports said loop taker for rotation around said first rotative axis, driver means (3) driven for rotation around a second rotative axis (4) which intersects said first rotative axis at a predetermined intersecting point (21), said driver means having at least three projections (10*a*, 10*b*, 10*c*), said projections being disposed in a surface (6) perpendicular to said second rotative axis and being angular spaced with an angular distance of less than 180 degrees at positions equidistant from said second rotative axis;

said loop taker having at least three engaging holes (17*a*, 17*b*, 17*c*) in its bottom surface wall for receiving said respective projections, said engaging holes being angularly spaced around the first rotative axis; and said first and second rotative axes being in positional relationship such that in a predetermined angular range in the rotation of the driver means, the respective projections are ready to escape from the corresponding engaging holes and during the rotation of the driver means the projections are successively received in the corresponding engaging holes in such a manner as to ensure that there is always at least one projection which has been received in the corresponding engaging hole.

2. A full rotary loop taker assembly as set forth in claim 1, wherein the number of said projections is three.

3. A full rotary loop taker assembly as set forth in claim 1, wherein said projections are angularly spaced with an equal angular distance.

4. A full rotary loop taker assembly as set forth in claim 1, wherein said intersecting point between said first and second rotative axes is positioned on or adjacent said bottom surface of said loop taker.

5. A full rotary loop taker assembly as set forth in claim 1, wherein the number of said projections is equal to the number of said engaging holes.

* * * * *